United States Patent [19]

McConnell

[11] 4,120,485

[45] Oct. 17, 1978

[54] FOLDING RACK AND WORK TABLE

[76] Inventor: Joseph W. McConnell, 9722 W. 136 La., Cedar Lake, Ind. 46303

[21] Appl. No.: 848,568

[22] Filed: Nov. 1, 1977

[51] Int. Cl.[2] ..... E02C 3/00

[52] U.S. Cl. ..... 254/88

[58] Field of Search ..... 254/5 R, 5 B, 5 C, 50, 254/88, 90; 187/8.41, 10, 12

[56] References Cited

U.S. PATENT DOCUMENTS 1,005,551 10/1911 Johnson ..... 254/88

FOREIGN PATENT DOCUMENTS 113,610 5/1926 Switzerland ..... 187/8.41

*Primary Examiner*—Robert C. Watson

*Attorney, Agent, or Firm*—Clarence A. O'Brien; Harvey B. Jacobson

[57] ABSTRACT

A folding service rack and work table unit has a rack part pivotally mounted on a wall structure or other suitable support for swinging movement between a storage position and a position for supporting a vehicle, such as a garden tractor, to be serviced. Hinged to the rack part at a portion thereof spaced farthest from the wall structure is a ramp part which permits the vehicle to be brought onto and removed from the rack means. The ramp part swings vertically so as to overlie the rack part when not needed, such as when the rack part is being employed as a work table.

11 Claims, 8 Drawing Figures

12
14
16
18
20'
22
22'
24
24'
26
26'
28
28'
30
30'
32
34
34'
2
3
B
S
V
W

Fig. 7
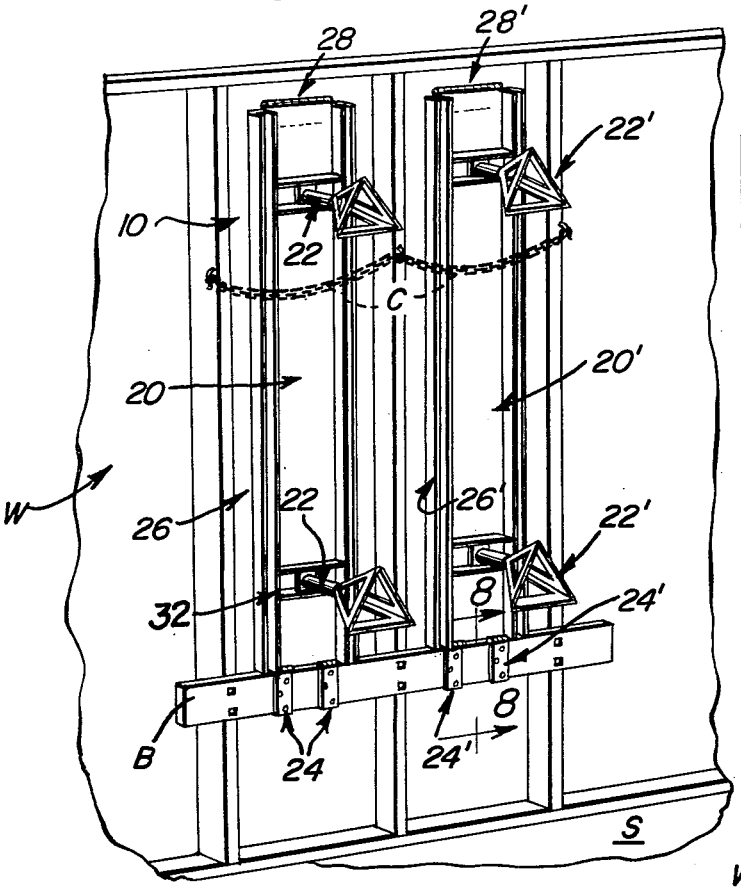
Fig. 6
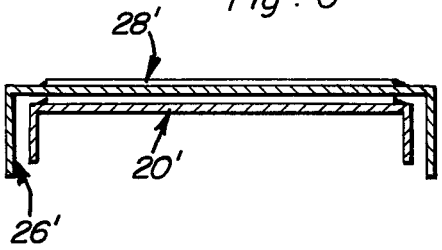
Fig. 3
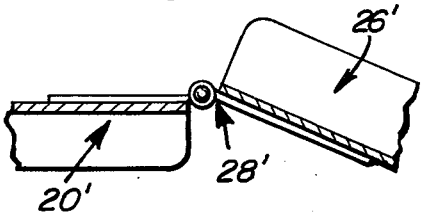
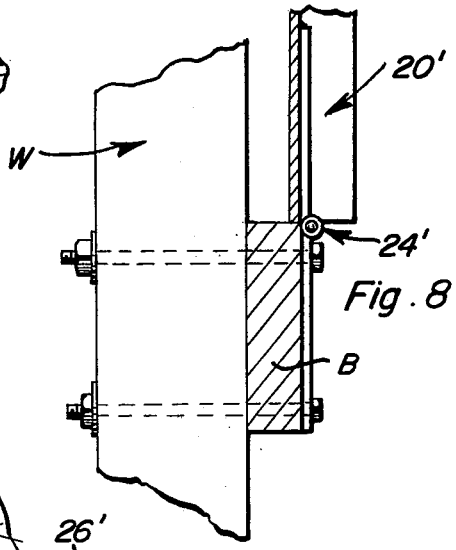
Fig. 8
Fig. 4
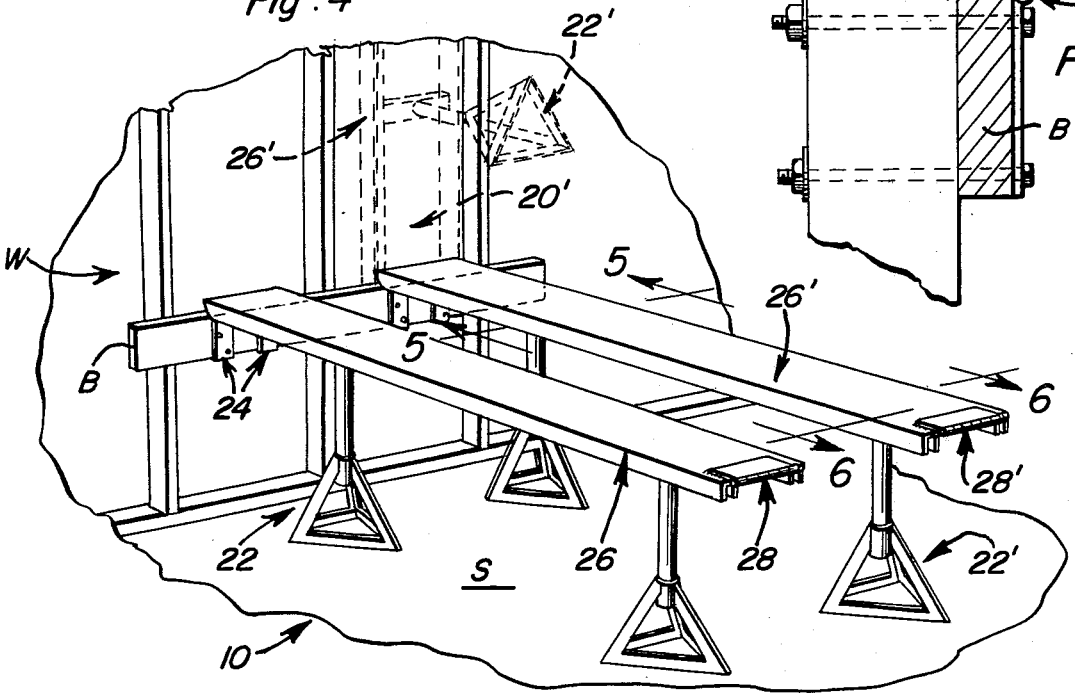

FOLDING RACK AND WORK TABLE

BACKGROUND OF THE INVENTION

1. Field of the Invention

This invention relates generally to a service rack and work table unit, and particularly to a folding rack suited for arrangement within a garage, and the like, for use in servicing such vehicles as garden tractors, and which can be folded against a wall of the garage when not in use in order to free additional space within the structure for other purposes.

2. Description of the Prior Art

Motor vehicle service racks, as exemplified in U.S. Pat. No. 2,576,544, issued Nov. 27, 1951 to R. D. Smith, have long been known and commonly used for lifting a motor vehicle to an elevated position in order to gain access to the undersurface of the vehicle and perform maintenance and repairs thereto. In particular, U.S. Pat. Nos: 1,519,977, issued Dec. 16, 1924 to K. B. Harvey; 1,528,934, issued Mar. 10, 1925 to J. F. McMahon; 1,538,437, issued May 19, 1925 to A. C. Larsen; and 1,968,672, issued July 31, 1934 to J. F. Duby; disclose vehicle work racks, intended for automobiles and motor trucks, which incorporate various associated structure, such as platforms, arranged for facilitating work on a motor vehicle disposed on the rack. These known vehicle work racks, however, are generally large, heavy, and in some cases quite complex in construction. Further, although the ramps associated with the racks for permitting a vehicle to pass onto and off of the rack are generally hinged to the tracks forming the vehicle supporting portion of the rack itself, this hinged construction is only for purposes of adjustment. Accordingly, the known vehicle service racks are generally installed in a permanent manner so as to occupy a rather large amount of available floor space.

U.S. Pat. No. 3,863,890, issued Feb. 4, 1975 to C. Ruffing, discloses a lift device for small equipment which is employed to elevate snowmobiles, and the like, to a convenient height for servicing and repairing the vehicle, while U.S. Pat. No. 3,606,253, issued Sept. 20, 1971 to D. Wooten, et al, discloses a portable vehicle rack intended for supporting only a single wheel of a vehicle.

SUMMARY OF THE INVENTION

It is an object of the present invention to provide a service rack and work table unit especially suited for servicing of garden tractors, riding lawn mowers, and the like.

It is another object of the present invention to provide a service rack and work table unit which is pivotally mounted to an associated wall or other supporting structure for pivoting into a storage position when not in use so as to free for other purposes the space in a garage, and the like, necessarily occupied by the unit when same is in a working position.

It is yet another object of the present invention to provide a folding service rack and work table unit which is constructed in a pair of sections for facilitating adaption of the unit to fit between the studs of a garage wall, and the like.

A still further object of the present invention is to provide a folding service rack and work table unit suitable for placement within a garage, and the like, for the servicing of small equipment and for use as a work table or bench which is simple and economical of construction, lightweight, and can be moved from a storage position to an operative position in a matter of only a few seconds by a single person.

These and other objects are achieved according to the present invention by providing a service rack and work table unit having: a rack part for supporting a vehicle to be serviced and/or functioning as a work table or bench; and a ramp part attached to the rack part for permitting the vehicle to be brought onto and removed from the rack part.

The rack part preferably includes an attachment arrangement for pivotally mounting the rack part onto a support structure and permitting the rack part to swing between a storage position and a work position. The rack part itself advantageously includes a planar table supported on a support surface so as to lie in a substantially horizontal plane by a stand assembly including a plurality of supports disposed in spaced relation from one another and extending codirectionally from the planar table. The latter includes a pair of substantially, spaced, straight tracks, with at least two of the aforementioned supports associated with each of the tracks. The tracks are pivotally mounted at a longitudinal end thereof to the aforementioned supporting structure as by hinges.

The ramp part is pivotally mounted on the rack part in spaced relation to the attachment arrangement, or hinges, and arranged for folding onto the upper surface of the table, that being the surface spaced from the surface from which the supports extend, when the entire unit is to be put into the storage position, or when the unit is being used as a work table or bench without a vehicle being disposed on the back part of the unit. The ramp part itself includes a pair of substantially parallel, spaced, longitudinally extending treads, each of which tread is pivotally attached to a respective one of the tracks for providing a continuous path therewith for the wheels of a vehicle to be serviced.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an enlarged, fragmentary, sectional view taken generally along the line 3—3 of FIG. 1.

FIG. 4 is a fragmentary, schematic, perspective view showing the unit of FIG. 1 with the ramp part thereof folded over onto the rack part of the unit.

FIG. 6 is an enlarged, sectional view taken generally along the line 6—6 of FIG. 4.

FIG. 7 is a fragmentary, schematic, perspective view showing the unit of FIGS. 1 and 4 in a folded position against a supporting wall of a garage, and the like.

FIG. 8 is an enlarged, fragmentary, sectional view taken generally along the line 8—8 of FIG. 7.

DESCRIPTION OF THE PREFERRED EMBODIMENTS

Figures 1, 2, 5:
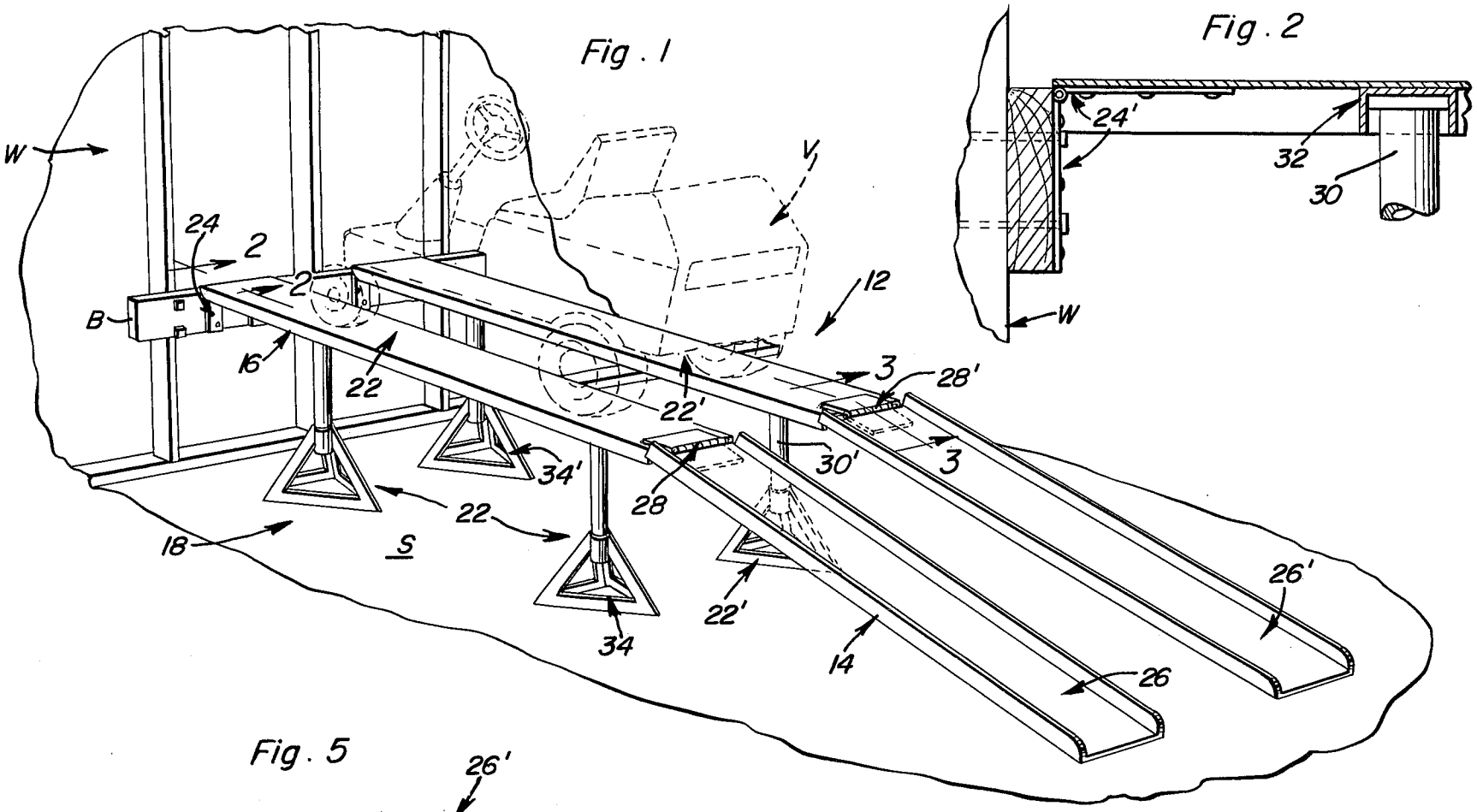
FIG. 1 is a fragmentary, schematic, perspective view showing a folding service rack and work table unit according to the present invention.
FIG. 2 is an enlarged, fragmentary, sectional view taken generally along the line of 2—2 of FIG. 1.
FIG. 5 is an enlarged, fragmentary, sectional view taken generally along the line 5—5 of FIG. 4.

Referring now more particularly to FIGS. 1-3 of the drawings, a service rack and work table unit 10 according to the present invention includes a rack part 12 for supporting a vehicle V to be serviced, and a ramp part 14 attached to part 12 and arranged for permitting vehicle V to be brought onto and removed from part 12.

Rack part 12 includes a planar table 16 supported on a support surface S in a substantially horizontal plane by a stand assembly 18. Table 16 is itself formed by a pair of substantially parallel, laterally spaced, straight tracks 20 and 20', with the stand assembly 18 including a plurality of separate, spaced supports 22, 22'. More specifically, track 20 is provided with a pair of supports 22 spaced along the longitudinal extent of track 20, while track 20' is provided with a pair of supports 22' likewise spaced longitudinally of the extent of track 20'. It is to be understood that the number of supports used with each track can be varied in dependence on the length of the tracks. Rack part 12 further includes an attachment arrangement including hinges 24 and 24' for pivotally mounting the tracks 20 and 20', respectively, on a brace B attached to and arranged extending across the plurality of the studs partially forming a wall W, which may be the wall of a garage (not shown), and the like. Hinges 24, 24' pivotally mount tracks 20, 20' in such a manner as to permit rack part 12 to swing between a storage position, as seen in FIG. 7, and operative positions, as seen in FIGS. 1 and 4.

Ramp part 14 includes a pair of substantially parallel, spaced, longitudinally extending treads 26 and 26', each of which treads 26, 26' is pivotally attached to a respective one of the tracks 20, 20' for providing a continuous path with a track 20, 20' for one set of wheels of a vehicle V. The pivotal attachment of treads 26, 26' to tracks 20, 20' is accomplished by hinges 28, 28' respectively, which hinges 28, 28' are attached, as perhaps can best be seen in FIG. 3, in such a manner as to permit treads 26, 26' to swing vertically through an angle of 180° from the normal position of treads 26, 26' engaging support surface S so as to rest in overlying relationship on the associated tracks 20, 20', as is seen in FIG. 4.

Each of the supports 22, 22' includes a post 30, 30' received in an associated channel 32, 32' affixed between the flanges of the generally channel-shaped associated track 20, 20', and being retained in a substantially vertical orientation by an appropriate base 34, 34'. While the bases 34, 34' have been illustrated as generally in the shape of a pyramid, it is to be understood that other suitable configurations, such as that of a quadrapod can be employed as the support basis.

Referring now to FIGS. 4-8 in conjunction with FIGS. 1-3, it will be seen that when the unit is arranged as seen in FIG. 1 of the drawings, a vehicle V can be readily driven or otherwise propelled up the ramp part 14 and onto rack part 12 for servicing, repair, and the like. Once the vehicle V is removed from rack part 12, the ramp part 14, or more specifically the individual threads 26, 26' can be swung vertically so as to overlie the associated tracks 20, 20' of rack part 12, as is seen in FIG. 4. It will be appreciated that the direction of extension of the flanges of the tracks 20, 20', and the treads 26, 26' will be in opposite directions when the unit is in the operative position seen in FIG. 1, so that the two pairs of flanges will be coextensive when the elements are in the relative positions seen in FIG. 4. The treads 26, 26' will be of slightly greater width than the tracks 20, 20' to permit a nesting arrangement as seen in FIG. 6. When arranged as in FIG. 4, the unit 10 can be used as a work table or bench, but with the space ordinarily taken up by the ramp part 14 being freed for other purposes. When arranged as seen in FIG. 4, a suitable sheet of substantially rigid material, not shown, can be arranged over the nested treads 26, 26' in tracks 20, 20' to provide a larger, uninterrupted work surface.

When the entire unit 10 is swung into the position seen in FIG. 7 of the drawings, it will be appreciated that the device will be substantially flush with wall W, freeing virtually the entire space of the garage, and the like, in which unit 10 is disposed for other purposes, such as the storage of automobiles. While the post 30, 30' of supports 22, which are attached to their associated channels 32, 32' in an appropriate manner such as welding, will cause the base 34, 34' to extend some distance from wall W, such distance will not be sufficiently great to seriously intrude into the building space. More specifically, when folded for storage as seen in FIG. 7, the lowermost supports 22, 22', or more specifically the bases 34, 34' thereof, will clear surface S by an amount substantially in excess of the usual bumper height of an automobile. Thus, even in the smallest standard size garages, a full size car can be accommodated in the garage when unit 10 is in the position shown in FIG. 7.

It will also be noted that each of the individual sections of unit 10, formed by a track 20, 20' and an associated tread 26, 26', respectively, fits between the studs of wall W in a convenient manner. As an additional feature, only one section, comprising a track 20, 20' and an associated tread 26, 26', can be lowered by swinging about the wall cleat or brace B at a time in order to permit running the front end or rear end of an automobile (not shown) part way onto the unit section for oil changes, minor engine repairs, exhaust and muffler work, transmission checking, and the like, although the invention is primarily intended for servicing of garden tractors, riding lawn mowers, and the like.

As can be understood from the above description and from the drawings, a foldable service rack and work table according to the present invention provides a simple and readily installable, yet rugged and efficient device for facilitating the servicing of small equipment without permanently tieing up valuable garage space.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A service rack and work table unit, comprising, in combination:

(a) rack means for supporting a vehicle to be serviced and including a planar table surface; and (b) ramp means attached to the rack means for permitting the vehicle to be brought onto and removed from the rack means, the rack means including attachment means pivotally mounting the rack means on a support for swinging movement between a storage position wherein the planar table surface is substantially vertical and a work position wherein the planar table surface is substantially horizontal.

2. A structure as defined in claim 1, wherein the rack means further includes:

stand means for supporting the table surface on a support surface in a substantially horizontal plane.

3. A structure as defined in claim 2, wherein the table includes a pair of substantially parallel, spaced, straight tracks, with the stand means including a plurality of separate, spaced supports, and each of the tracks having mounted thereon at least two of the supports.

4. A structure as defined in claim 3, wherein the ramp means is pivotally mounted on the rack means in spaced relation to the attachment means and arranged for folding onto the table in overlying relationship with the table.

5. A structure as defined in claim 4, wherein the ramp means includes a pair of substantially parallel, spaced, longitudinally extending treads, each of the treads being pivotally attached to a respective one of the tracks for providing a continuous wheel path therewith.

6. A structure as defined in claim 1, wherein the ramp means is pivotally mounted on the rack means and arranged for being folded onto the rack means in overlying relation therewith.

7. In combination is an upstanding, planar wall, a service rack and work table unit, comprising, in combination:

(a) rack means for supporting a vehicle to be serviced; and (b) ramp means attached to the rack means for permitting the vehicle to be brought onto and removed from the rack means, the rack means including attachment means pivotally mounting the rack means on the wall for swinging movement between a storage position substantially parallel to and adjacent the wall and a work position substantially horizontal and perpendicular to the wall.

8. A structure as defined in claim 7, wherein the further includes:

stand means for supporting the table surface on a support surface in a substantially horizontal plane.

9. A structure as defined in claim 8, wherein the table includes a pair of substantially parallel, spaced, straight tracks, with the stand means including a plurality of separate, spaced supports, and each of the tracks having mounted thereon at least two of the supports.

10. A structure as defined in claim 9, wherein the ramp means is pivotally mounted on the rack means in spaced relation to the attachment means and arranged for folding onto the table in overlying relationship with the table.

11. A structure as defined in claim 10, wherein the ramp means includes a pair of substantially parallel, spaced, longitudinally extending treads, each of the treads being pivotally attached to a respective one of the tracks for providing a continuous wheel path therewith.

* * * * *